US005452678A

United States Patent [19]

Simpkins

[11] Patent Number: 5,452,678

[45] Date of Patent: Sep. 26, 1995

[54] TOP FOR A PONTOON BOAT

[75] Inventor: Terry J. Simpkins, Carlsbad, Calif.

[73] Assignee: Harris-Kayot, Inc., Fort Wayne, Ind.

[21] Appl. No.: 135,805

[22] Filed: Oct. 13, 1993

[51] Int. Cl.[6] ..... B63B 17/00

[52] U.S. Cl. ..... 114/361; 114/61

[58] Field of Search ..... 114/71, 61, 361, 114/343, 65 R; 52/262, 263; 296/104, 29, 164; 440/11

[56] References Cited

U.S. PATENT DOCUMENTS

| | | | |
|---|---|---|---|
| 2,489,670 | 11/1949 | Powell, Jr. | 296/29 |
| 2,994,294 | 8/1961 | Roth | 440/11 |
| 3,866,381 | 2/1975 | Eschbach et al. | 52/262 |
| 4,542,933 | 9/1985 | Bischoff | 296/164 |
| 4,784,076 | 11/1988 | Carlsson | 114/71 |

OTHER PUBLICATIONS

Catalog entitled "KAYOT 1993".
Catalog entitled "Harris Flote Bote '93".

*Primary Examiner*—Edwin L. Swinehart

*Attorney, Agent, or Firm*—Baker & Daniels

[57] ABSTRACT

The invention is directed to a boat having a buoyant lower portion and a plurality of upstanding support members connected to the lower portion. The top for the boat includes two end rails, two side rails respectively connected to the end rails, and a roof extending between and connected to the side rails and end rails. The side rails are comprised of a metal extrusion defining a first channel which is generally U-shaped and opens in a generally downward direction. The upstanding support members are received within the first generally U-shaped channel. In another aspect of the invention, the two side rails comprise an extrusion including a curved intermediate portion having a convex exterior profile. The roof is attached at one edge of the curved intermediate portion. In yet another aspect of the invention, the side rail comprises an extrusion including a recess which receives at least one of the upstanding support members.

18 Claims, 4 Drawing Sheets

TOP FOR A PONTOON BOAT

BACKGROUND OF THE INVENTION

1. Field of the Invention

The present invention relates to a top for a boat, and, more particularly, to a rigid top for a pontoon boat.

2. Description of the Related Art

Pontoon boats of conventional design include a buoyant lower portion having a platform and a pair of flotation tubes. The platform is connected to the flotation tubes at the bottom side thereof. An upstanding fence is attached at the perimeter edge of the platform at the top side thereof. A pontoon boat may be configured with a top which is supported by way of a plurality of upstanding support members attached either to the fence or directly to the platform. The top protects passengers from exposure to rain and ultraviolet radiation. The fence, upstanding support members and top define a superstructure of the pontoon boat.

Tops for boats of conventional design typically include a plurality of square tubular elongated members which are welded together to form the support structure for the top. The tubular elongated members define side rails, and roof support bows extending therebetween. Sheet metal is then placed over and fastened to the tubing with appropriate fasteners, such as rivets or screws. Trim pieces are utilized at the edges of the sheet metal to cover the sharp edges of the sheet metal and hide the screws used for fastening the sheet metal to the tubing. Corner caps may be used at the corners of the top.

A problem with conventional boat tops is that all the trim pieces necessary for hiding the sheet metal edges and fasteners have the appearance of add-on hardware, which may be considered as having an unsightly appearance.

Moreover, with boat tops of conventional design, the top is usually affixed to the plurality of upstanding support members by welding respective brackets to the bottom of the side rails of the top at predetermined locations. The brackets may be configured, e.g., with holes for receiving a bolt or other suitable fastener for attaching the respective upstanding support member to the bracket. A problem with such a design is that the desired location for attaching the upstanding support members to the fence or platform of the pontoon boat may vary from one model of boat to another. Accordingly, the brackets used for connecting the top to the upstanding support members must be welded to the tubular side rails at one of a plurality of varying locations. Such a design therefore increases manufacturing costs by requiring that the brackets be manually welded to the tubular side rails at respective predetermined locations.

Furthermore, after the brackets have been welded to the tubular side rails on a boat top of conventional design, the boat top cannot thereafter be easily adapted to fit on a different model pontoon boat having upright support members connected to the fence or platform at different locations.

Boat tops of conventional design also may include a shelf mounted at the back of the boat top for receiving boat cushions, life vests or the like. Such a shelf typically extends horizontally from one side rail to the other, immediately in front of a rear vertical wall. A problem with such a shelf is that during operation of the pontoon boat, air flows under the boat top and is trapped in the space defined by the rear vertical wall, sheet metal roof, and shelf. The shelf therefore defines an air scoop which increases air drag on the boat and hence decreases fuel efficiency and the maximum attainable speed of the boat.

Moreover, the shelf extending across in a generally horizontal direction from one side rail to the other decreases the effective height of the boat top at the rear end thereof to the height of the side rails, rather than the maximum height of the sheet metal roof at the center of the boat top. A tall person may therefore be required to bend over to exit to the rear portion of the pontoon boat for servicing of the engine or refueling.

What is needed in the art is a boat top which is configured to allow the sheet metal roof to be fastened to the top without the use of trim pieces for covering the edges of the sheet metal roof and the fasteners.

What is further needed in the art is a boat top which does not include a plurality of add-on trim pieces, brackets, etc., which impair the appearance and decrease the aerodynamic efficiency of the boat.

An additional need is a boat top which allows mounting thereof to a plurality of upstanding support members at any one of a plurality of locations, without reconfiguring the boat top.

A further need is a boat top having a shelf for storage of boat cushions, life vests, etc., which does not decrease the aerodynamic efficiency of the boat, and does not decrease the maximum effective height of the boat top at the rear edge thereof.

SUMMARY OF THE INVENTION

The present invention provides a boat top having side rails comprising a metal extrusion having a recess configured as a generally U-shaped channel which opens in a downward direction. The U-shaped channel is adapted to receive one or a plurality of upstanding support members at any desired location. The side rail includes a convex exterior profile for increasing aerodynamic efficiency and aesthetic appeal.

In general, the boat top of the present invention includes two end rails and a plurality of support bows which interconnect the two side rails. A sheet metal roof lies over the support bows and is connected to each of the respective side rails. The recess, which may be in the form of a U-shaped channel, opens downwardly and receives one or more of the upstanding support members, which are in turn attached to the fence or platform of the boat.

The invention comprises, in one form thereof, a boat having a buoyant lower portion and a plurality of upstanding support members connected to the lower portion. The top for the boat includes two end rails, two side rails respectively connected to the end rails, and a roof extending between and connected to the side rails and end rails. The side rails comprise a metal extrusion defining a first channel which is generally U-shaped and opens in a generally downward direction. The upstanding support members are received within the first generally U-shaped channel.

In another aspect of the invention, the two side rails comprise an extrusion including a curved intermediate portion having a convex exterior profile. The roof is attached at one edge of the curved intermediate portion.

In yet another aspect of the invention, the side rail comprises an extrusion including a recess which receives at least one of the upstanding support members.

An advantage of the present invention is that the upstanding support members extending from the fence or platform may be easily attached to the side rails of the boat top at any desired location.

Another advantage is that add on trim pieces, brackets, etc., are not needed to connect the side rails to the roof or upstanding support members, thereby decreasing required materials and labor.

Yet another advantage is that storage for boat cushions, life jackets, etc. is provided without decreasing the aerodynamic efficiency and maximum height of the boat top.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
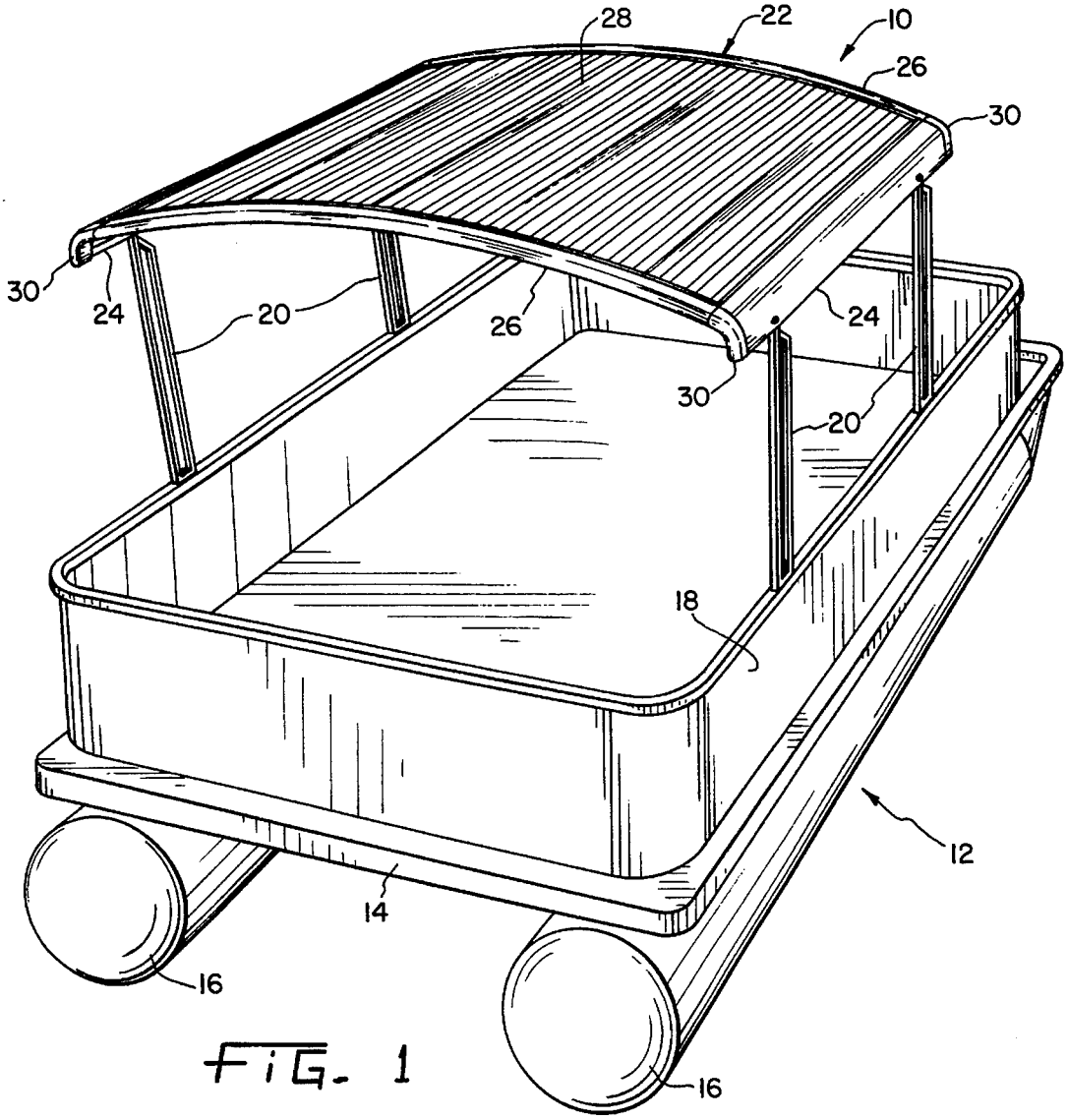
FIG. 1 is a perspective view of one embodiment of the boat top of the present invention, as viewed when mounted on a pontoon boat.

Referring now to the drawings and particularly to FIG. 1, there is shown a boat 10 having a buoyant lower portion 12, including a platform 14 connected to flotation tubes 16. Disposed at the upper perimeter and attached to platform 14 is an upstanding fence 18. Four upstanding support members 20 may be attached directly to upstanding fence 18 (as shown) or attached to platform 14. A top 22 includes two side rails 24, two end rails 26, a roof 28 extending between and connected to side rails 24 and end rails 26, and four corner pieces 30 respectively disposed between and interconnecting side rails 24 and end rails 26.

Figure 2:
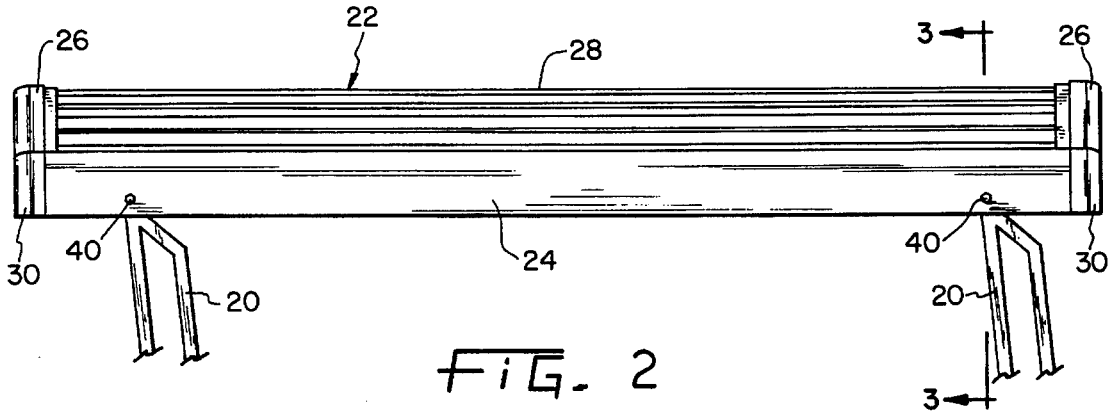
FIG. 2 is a fragmentary side view of the embodiment shown in FIG. 1.

FIG. 2 illustrates a fragmentary right side view of top 22 and upstanding support members 20 shown in FIG. 1. As will be described hereinafter, upstanding support members 20 are received within a recess formed in the bottom of each side rail 24, whereby upstanding support members 20 may be attached to side rails 24 at any desired location.

Figure 3:
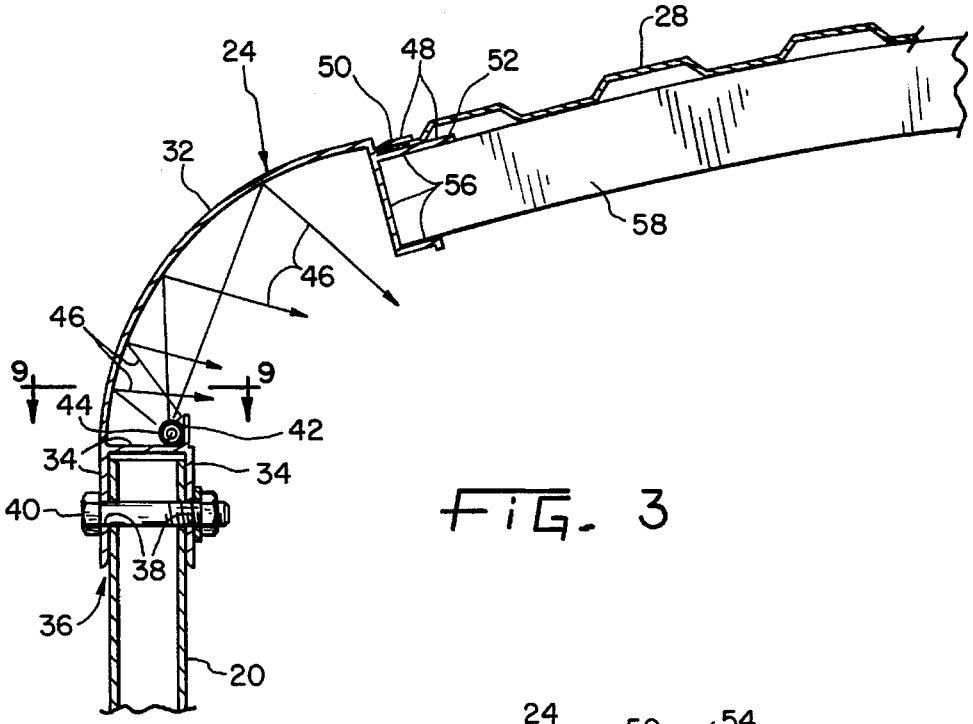
FIG. 3 is a sectional view taken along line 3—3 in FIG. 2.
Figure 4:
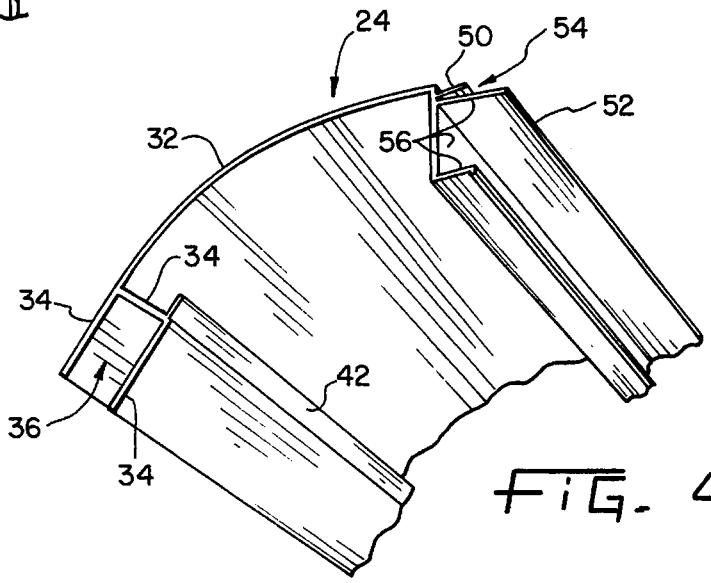
FIG. 4 is a detailed perspective view of the side rail shown in the embodiment illustrated in FIGS. 1–3.

FIG. 3 is a sectional view taken along line 3—3 in FIG. 2. Side rail 24 comprises a metal extrusion, i.e., aluminum extrusion, including a curved intermediate portion 32 having a convex exterior profile, i.e., side rail 24 has a convex shape as viewed from the outside of the pontoon. Curved intermediate portion 32 has a sheet-like cross-sectional profile. Disposed adjacent a lower edge of curved intermediate portion 32 is a first generally U-shaped channel 34 defining a recess 36 (FIG. 4). U-shaped channel 34 opens in a generally downward direction (FIG. 3) and receives at least one upstanding support member 20 at any desired located. That is, upstanding support member 20 may be received within recess 36 at any desired location along the longitudinal length of side rail 24. An opening 38 is formed in U-shaped channel 34 at the desired mounting location of upstanding support member 20 and receives a bolt assembly 40, which thereby attaches upstanding support member 20 to side rail 24.

Disposed adjacent U-shaped channel 34 is an upstanding wall 42 which is disposed interior of curved intermediate portion 32. A conventional strip light 44 comprising a plurality of electrically connected LED lights disposed within a translucent plastic tube is disposed adjacent the exterior side of upstanding wall 42. In the embodiment shown, side rail 24 is formed from a reflective metallic material causing light waves emitted from strip light 44 to be reflected from the exterior side of upstanding wall 22 and the interior side of curved intermediate portion 32, generally as indicated by directional arrows 46.

Disposed at an edge of curved intermediate portion 32 opposite from first generally U-shaped channel 34 is a second channel 48. Roof 28 is received within second channel 48 whereby roof 28 is attached to side rail 24. More particularly, second channel 48 includes a flange 50 disposed at an acute angle to a generally planar member 52. Flange 50 and generally planar member 52 define a space 54 therebetween (FIG. 4) in which roof 28 is received (FIG. 3). Flange 50 is deformable in a direction towards generally planar member 52, e.g., such as by a crimping operation, whereby flange 50 and generally planar member 52 frictionally engage roof 28. Flange 50 includes two slightly outwardly projecting beads on the side thereof adjacent roof 28 (not numbered for purposes of clarity) which extend along the longitudinal length of flange 50 and further ensure frictional engagement between flange 50 and roof 28.

Disposed adjacent second channel 48 is a third channel 56 having a generally U-shape. In the embodiment shown, generally planar member 52 comprises a common wall between second channel 48 and third channel 56. A plurality of roof support bows 58 (one of which is shown in FIG. 3) are received within third channel 56 and provide vertical support for sheet metal roof 28. In the embodiment shown, curved intermediate portion 32, first U-shaped channel 34, second channel 48, and third channel 56 comprise an aluminum extrusion, and are thus of monolithic construction.

Figure 5:
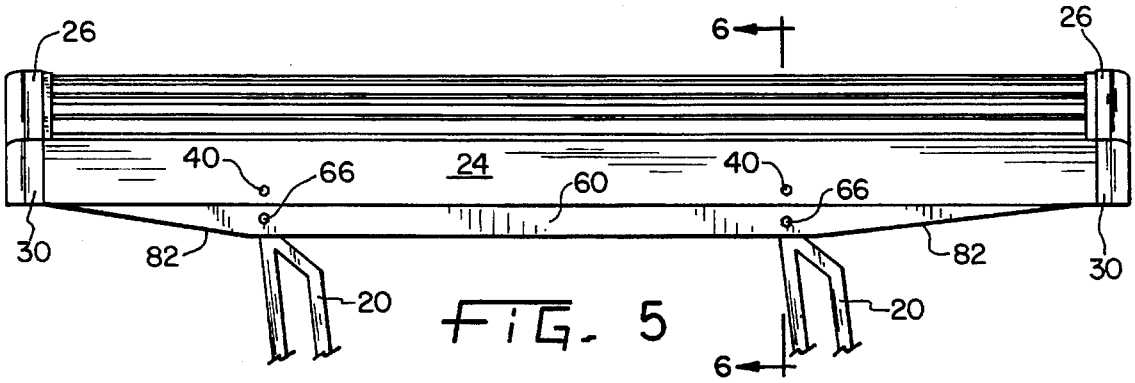
FIG. 5 is a fragmentary side view of another embodiment of the boat top of the present invention, having a decorative skirt attached to the bottom of the side rail.
Figure 6:
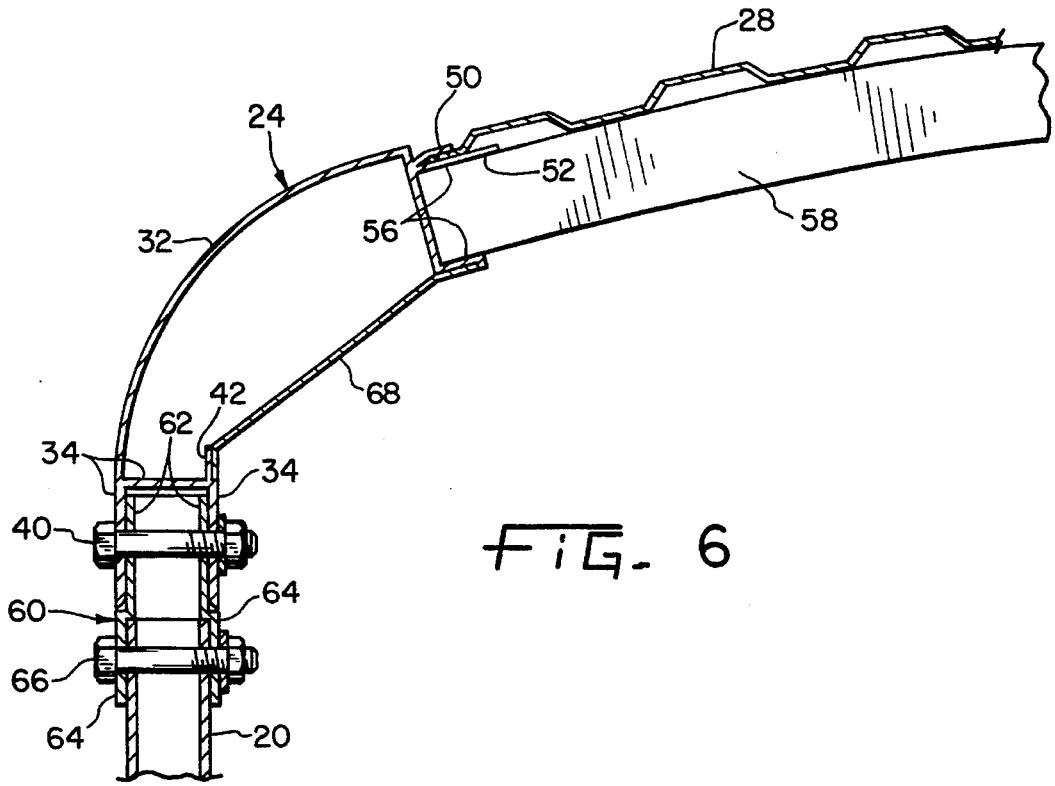
FIG. 6 is a sectional view taken along line 6—6 in FIG. 5.

FIGS. 5 and 6 illustrate another embodiment of the present invention which differs from the embodiment shown in FIGS. 1–3 in two primary respects. First, a decorative skirt 60 is attached to the bottom of first U-shaped channel 34. Decorative skirt 60 includes a male portion 62 which is received within first U-shaped channel 34. Male portion 62 is connected to U-shaped channel 34 using a bolt assembly 40, as described above. Male portion 62 is attached to a wider female portion 64 which has an exterior width about the same as U-shaped channel 34 (FIG. 6) and defines a fourth generally U-shaped channel disposed under male portion 62, and which opens in a generally downward direction. At least one upstanding support member 20 is received within female portion 64 and is connected thereto via a bolt assembly 66.

Additionally, in the embodiment shown in FIG. 6, upstanding wall 42 does not include a strip light disposed on the exterior side thereof. Rather, a stiffening member 68 extends between upstanding wall 42 (adjacent first U-shaped channel 34) to third channel 66. Stiffening member 68 may be fastened by appropriate means, such as welding, rivets, or the like, and provides resistance against flexure of side rail 24.

Figure 7:
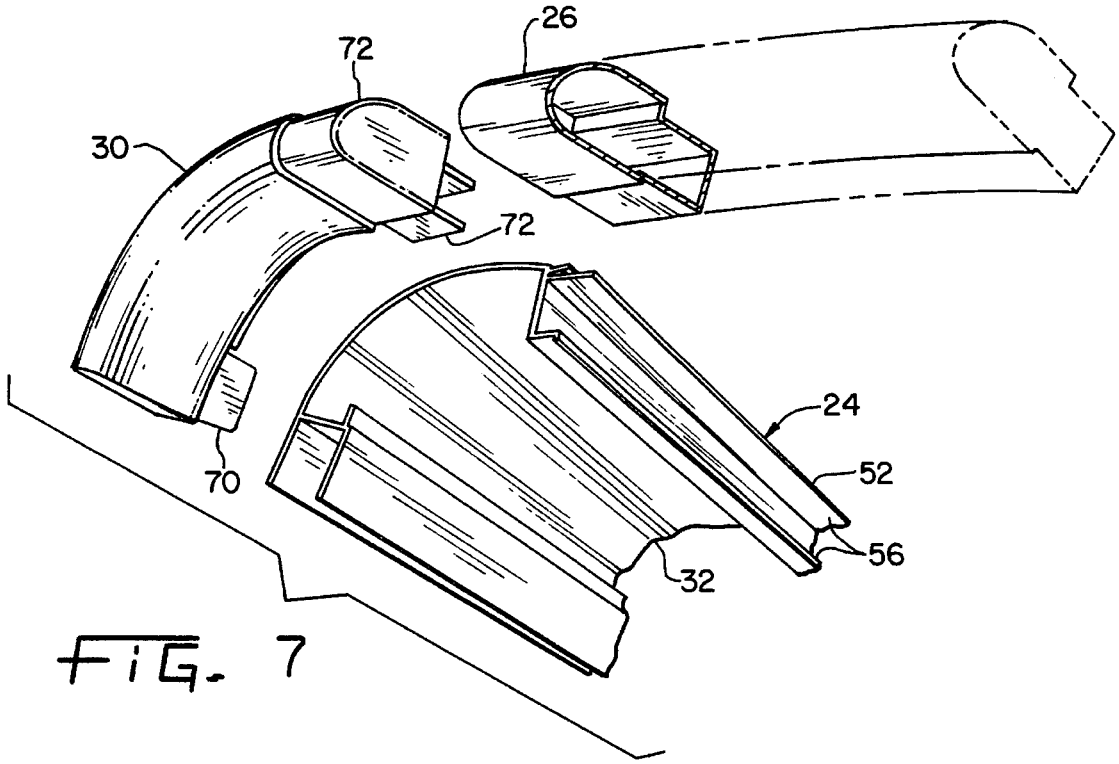
FIG. 7 is an exploded perspective view illustrating interconnection between the side rail, corner piece, and end rail.

FIG. 7 is an exploded view of a side rail 24, end rail 26, and corner piece 30, illustrating interconnection therebetween. Corner piece 30 is formed from cast aluminum and includes male extensions 70 and 72 for respectively sliding into and engaging side rail 24 and end rail 26. One way of interconnecting side rail 24 and end rail 26 via corner piece 30 is to slide male extension 70 or 72 into the respective side rail 24 or end rail 26. The other of side rail 24 and end rail 26 is then slid onto the remaining male extension 70 or 72. Preferably, side rail 24 and end rail 26 are then welded together to thereby hold the corner piece 30 in place. Alternatively, corner piece 30 may be fastened directly to side rail 24 and end rail 26 by suitable fastening means, e.g., such as screws or rivets.

Figure 8:
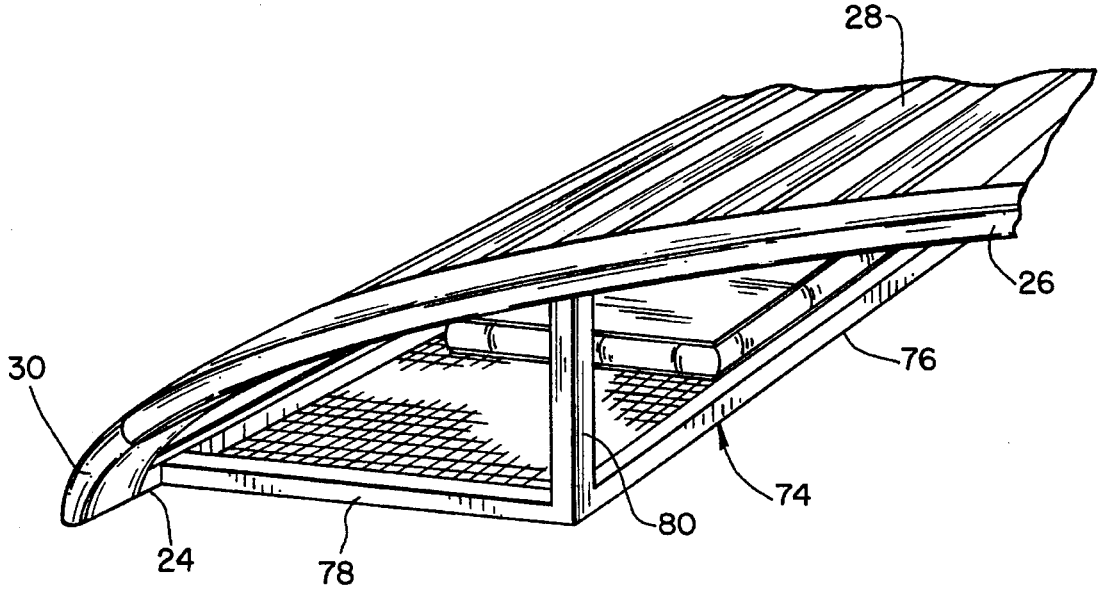
FIG. 8 is a fragmentary perspective view of an embodiment of the boat top of the present invention having a side shelf.

FIG. 8 illustrates another feature of the present invention. Referring to FIG. 1, top 22 has a convex curvature causing water to flow towards side rails 24. It is thus apparent that the maximum height between platform 14 and end rails 26 is at a location corresponding to half of the width of boat 10. With tops of conventional design (not shown) a shelf may extend between and be disposed at the rearward end of side rails 24. It is thus apparent that with conventional tops, the maximum height between platform 14 and top 22 is decreased to the minimum height of side rail 24. Referring now to the embodiment shown in FIG. 8, a generally horizontal elongated shelf 74 is attached to and extends from a side rail 24. Shelf 74 extends along a longitudinal length of side rail 24 and includes a first frame member 76, an end frame member 78 interconnecting side rail 24 and frame member 76, and a second end frame member disposed at the opposite end of frame member 76 (not shown). Side rail 24, end frame member 78, frame member 76, and the second end frame member define a rectangular frame which is disposed generally horizontally. A vertical support member 80 is connected to end rail 26 and shelf 74 and supports shelf 74 in a vertical direction. A second vertical support member (not shown) is disposed at the opposite end of frame member 76.

Figure 9:
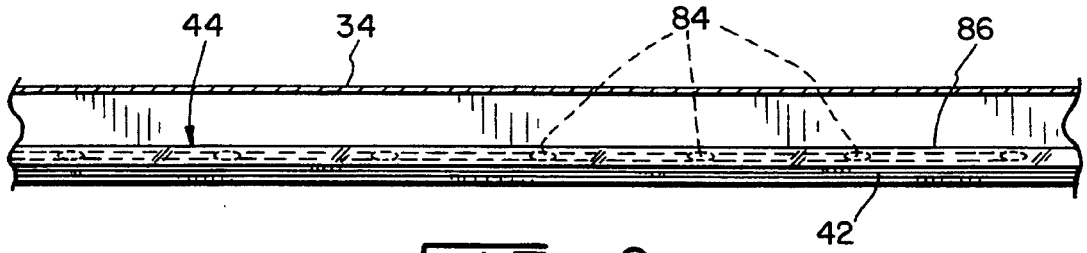
FIG. 9 is a sectional view taken along line 9—9 in FIG. 3.

FIG. 9 is a sectional view taken through line 9—9 in FIG. 3 and illustrates in greater detail the configuration of strip light 44 disposed adjacent upstanding wall 42. Strip light 44 includes a plurality of LED's 84 connected in parallel and hermetically disposed within a transparent tube 86. Strip light 44 is connected to an external source of electrical power (not shown).

In the embodiment of the present invention shown in FIG. 5, decorative skirt 60 is shown with a taper at each longitudinal end thereof. Decorative skirt 60 comprises an aluminum extrusion which is cut subsequent to the extrusion process to define tapered surfaces 82. However, it is to be understood that decorative skirt 60 may be formed to have different visual appearances. For example, decorative skirt 60 may extend the full length of side rail 24 without a taper formed at each longitudinal end thereof.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pontoon boat, comprising:

a pair of flotation tubes;

a platform disposed above and connected to said flotation tubes;

a plurality of upstanding support members extending upward from and connected to said platform;

a roof; and two side rails connected to said roof at opposite side edges of said roof, each said side rail including a curved intermediate portion, a first generally U-shaped channel disposed at an edge of said curved intermediate portion opposite said roof and opening in a generally downward direction, said upstanding support members received within said first channel, and a second channel disposed at an edge of said curved intermediate portion opposite said first channel, said roof received within said second channel, said second channel comprising a flange disposed at an acute angle to a generally planar member, said roof slidable into a space defined between said flange and said generally planar member, said flange deformable towards said generally planar member for frictionally engaging said roof.

2. The boat top of claim 1, wherein said flange includes at least one bead on a side thereof facing said roof.

3. A pontoon boat, comprising:

a pair of flotation tubes;

a platform disposed above and connected to said flotation tubes;

a plurality of upstanding support members extending upward from and connected to said platform;

a roof; and two side rails connected to said roof at opposite side edges of said roof, each said side rail including a curved intermediate portion, a first generally U-shaped channel disposed at an edge of said curved intermediate portion opposite said roof and opening in a generally downward direction, said upstanding support members received within said first channel, a second channel disposed at an edge of said curved intermediate portion opposite said first channel, said roof received within said second channel, a third channel disposed adjacent said second channel, and a plurality of roof support bows received within said third channel.

4. The boat top of claim 3, wherein said curved intermediate portion has a sheet cross-sectional profile and defines an exterior surface of said respective side rail, and further comprising a stiffening member extending between said first channel and said third channel.

5. A pontoon boat, comprising:

a pair of flotation tubes;.

a platform disposed above and connected to said flotation tubes;

a plurality of upstanding support members extending upward from and connected to said platform;

a roof; and two side rails connected to said roof at opposite side edges of said roof, each said side rail including a curved intermediate portion, a first generally U-shaped channel disposed at an edge of said curved intermediate portion opposite said roof and opening in a generally downward direction, said upstanding support members received within said first channel, an upstanding wall, and a light disposed interiorly adjacent said upstanding wall.

6. The boat top of claim 5, wherein said upstanding wall is comprised of a reflective material for reflecting a portion of lightwaves emitted by said light.

7. The boat top of claim 6, wherein said curved intermediate portion is comprised of a reflective material for reflecting at least a portion of lightwaves emitted by said light.

8. A pontoon boat comprising:

a pair of flotation tubes;

a platform disposed above and connected to said flotation tubes;

a plurality of Upstanding support members extending upward from and connected to said platform;

a roof;

two side rails connected to said roof at opposite side edges of said roof, each said side rail having a monolithic construction and including a curved intermediate portion, and a first generally U-shaped channel disposed at an edge of said curved intermediate portion opposite said roof and opening in a generally downward direction, said upstanding support members received within said first channel;

two end rails disposed between said side rails at opposite edges of said roof, and four corner pieces respectively interconnecting an end of one said end rail to an end of one side rail; and an elongated shelf having a length extending generally parallel to a longitudinal direction of each said side rail, wherein said shelf comprises a rectangular frame disposed generally horizontally, and having a bottom comprised of netting.

9. A pontoon boat, comprising:

a pair of flotation tubes;

a platform disposed above and connected to said flotation tubes;

a plurality of upstanding support members extending upward from and connected to said platform;

a roof;

two side rails connected to said roof at opposite side edges of said roof, each said side rail including a curved intermediate portion, and a first generally U-shaped channel disposed at an edge of said curved intermediate portion opposite said roof and Opening in a generally downward direction, said upstanding support members received within said first channel; and a decorative skirt, said skirt including a male portion received within said first channel, and a fourth generally U-shaped channel disposed under said male portion and opening in a generally downward direction, at least one of said upstanding support members received within said fourth channel.

10. A pontoon boat, comprising:

a pair of flotation tubes;

a platform disposed above and connected to said flotation tubes;

a plurality of upstanding support members extending upward from and connected to said platform;

a roof; and two side rails connected to said roof at opposite side edges of said roof, each said side rail including a curved intermediate portion, a first generally U-shaped channel disposed at an edge of said curved intermediate portion opposite said roof and opening in a generally downward direction, said upstanding support members received within said first channel, and a second channel disposed at an edge of said curved intermediate portion opposite said first channel, said roof received within said second channel, said second channel comprising a flange disposed at an acute angle to a generally planar member, said roof slidable into a space defined between said flange and said generally planar member, said flange deformable towards said generally planar member for frictionally engaging said roof.

11. The boat top of claim 10, wherein said flange includes at least one bead on a side thereof facing said roof.

12. The boat top of claim 10, wherein each said side rail further comprises a third channel disposed adjacent said second channel, and further comprising a plurality of roof support bows received within said third channel.

13. The boat top of claim 12, wherein said side rail includes a curved intermediate portion having a sheet cross-sectional profile and defines an exterior surface of said respective side rail, and further comprising a stiffening member extending between said recess and said third channel.

14. A pontoon boat, comprising:

a pair of flotation tubes;

a platform disposed above and connected to said flotation tubes;

a plurality of upstanding support members extending upward from and connected to said platform;

a roof; and two side rails connected to said roof at opposite side edges of said roof, each said side rail including a curved intermediate portion, a first generally U-shaped channel disposed at an edge of said curved intermediate portion opposite said roof and opening in a generally downward direction, said upstanding support members received within said first channel, an upstanding wall, and a light disposed interiorly adjacent said upstanding wall.

15. A pontoon boat, comprising:

a pair of flotation tubes;

a platform disposed above and connected to said flotation tubes;

a plurality of upstanding support members extending upward from and connected to said platform;

a roof; and two side rails connected to said roof at opposite side edges of said roof, each said side rail including a curved intermediate portion, a first generally U-shaped channel disposed at an edge of said curved intermediate portion opposite said roof and opening in a generally downward direction, said upstanding support members received within said first channel, an upstanding wall, and a light disposed interiorly adjacent said upstanding wall, wherein said upstanding wall is comprised of a reflective material for reflecting a portion of lightwaves emitted by said light.

16. The boat top of claim 15, wherein said curved intermediate portion is comprised of a reflective material for reflecting at least a portion of lightwaves emitted by said light.

17. A boat, comprising:

a buoyant lower portion;

a superstructure including a plurality of upstanding support members extending upward from and attached to said lower portion;

a roof;

a monolithic side rail disposed at an edge of and attached to said roof, said side rail having a substantially constant cross-sectional shape along a longitudinal length thereof and including a first channel, at least one of said upstanding support members received within said first channel;

two end rails disposed between said side rails at opposite edges of said roof, and four corner pieces respectively interconnecting an end of one said end rail to an end of one said side rail; and an elongated shelf having a length extending generally parallel to a longitudinal direction of each said side rail, wherein said shelf comprises a rectangular frame disposed generally horizontally, and having a bottom comprised of netting.

18. A boat, comprising:

a buoyant lower portion;

a superstructure including a plurality of upstanding support members extending upward from and attached to said lower portion;

a roof;

a monolithic side rail disposed at an edge of and attached to said roof, said side rail having a substantially constant cross-sectional shape along a longitudinal length thereof and including a first channel, at least one of said upstanding support members received within said first channel; and a decorative skirt, said skirt including a male portion received within said recess, and a fourth generally U-shaped channel disposed under said male portion and opening in a generally downward direction, at least one of said upstanding support members received within said fourth channel.

* * * * *